US010626543B2

(12) United States Patent
Lim

(10) Patent No.: US 10,626,543 B2
(45) Date of Patent: Apr. 21, 2020

(54) INDUCTION HEATING SYSTEM FOR A DRYER APPLIANCE

(71) Applicant: Haier US Appliance Solutions, Inc., Wilmington, DE (US)

(72) Inventor: Tae-Hoon Lim, Seongnam-Si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 48 days.

(21) Appl. No.: 15/983,219

(22) Filed: May 18, 2018

(65) Prior Publication Data

US 2019/0352838 A1 Nov. 21, 2019

(51) Int. Cl.
*D06F 58/26* (2006.01)
*D06F 58/28* (2006.01)

(52) U.S. Cl.
CPC ..... *D06F 58/26* (2013.01); *D06F 58/28* (2013.01); *D06F 2058/289* (2013.01)

(58) Field of Classification Search
None
See application file for complete search history.

(56) References Cited

U.S. PATENT DOCUMENTS 4,181,846 A * 1/1980 Cunningham ..... D06F 58/26 219/619
7,017,280 B2 3/2006 Green et al.
9,544,945 B2 * 1/2017 Hadoulias ..... F24H 1/0018
2018/0057995 A1 * 3/2018 Kim ..... D06F 25/00
2019/0048509 A1 * 2/2019 Kim ..... D06F 23/04
2019/0048510 A1 * 2/2019 Kim ..... D06F 37/267
2019/0048515 A1 * 2/2019 Noh ..... D06F 58/04
2019/0048516 A1 * 2/2019 Kim ..... D06F 29/005
2019/0048517 A1 * 2/2019 Park ..... D06F 58/26
2019/0062981 A1 * 2/2019 Kim ..... H05B 6/06
2019/0186068 A1 * 6/2019 Kim ..... D06F 58/26
2019/0249355 A1 * 8/2019 Park ..... D06F 25/00
2019/0264375 A1 * 8/2019 Park ..... D06F 37/04

FOREIGN PATENT DOCUMENTS

CN 202170439 U 3/2012
EP 2400052 A1 12/2011
WO WO-2007091749 A1 * 8/2007 ..... F24H 3/0405

* cited by examiner

*Primary Examiner* — David J Laux
(74) *Attorney, Agent, or Firm* — Dority & Manning, P. A.

(57) ABSTRACT

A dryer appliance is provided including a cabinet and a drum defining a chamber and being rotatably mounted within the cabinet. An inlet duct is fluidly coupled to a chamber inlet and an air handler urges a flow of air through the inlet duct and into the chamber. An induction heating assembly is in thermal communication with the inlet duct and includes an induction coil for generating an electromagnetic field and a heating plate for generating heat when energized by the electromagnetic field. The induction heating assembly may be positioned proximate a rear wall of the chamber or in a heater box below the chamber. In addition, the heating plate may form part of a rear wall of the drum or may be positioned behind the rear wall.

20 Claims, 6 Drawing Sheets

INDUCTION HEATING SYSTEM FOR A DRYER APPLIANCE

FIELD OF THE INVENTION

The present subject matter relates generally to dryer appliances, and more particularly to induction heating systems for efficiently drying articles of clothing in dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance. Dryer appliances may further include filter systems for removing foreign materials, such as lint, from passing into the exhaust conduit, which can impair dryer performance and may present a fire hazard due to the potential for combustion.

Conventional heater assemblies include electrical resistance heaters such as wire coils that generate heat when electrical current is passed through them. Notably, these resistance heaters are typically only 70-80% efficient, resulting in significant wasted energy during operation. In addition, for example, current dryer appliances include two resistance heater coils which are connected to three-phase power systems to energize these heaters in one of three steps—OFF for no heat, one heater ON for low heat, or two heaters ON for high heat. Therefore, the temperature within the drum may not be controlled linearly, resulting in significant operating restrictions and limited versatility in terms of using different operating cycles to dry various load types.

Accordingly, improved dryer appliances including features for improved heating versatility are desirable. More specifically, dryer appliances including features for efficiently and linearly controlling a drum temperature would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance defining a vertical, a lateral, and a transverse direction. The dryer appliance includes a cabinet and a drum rotatably mounted within the cabinet, the drum defining a chamber for receipt of clothes for drying and a chamber inlet. An inlet duct is fluidly coupled to the chamber inlet and an air handler is in fluid communication with the inlet duct for urging a flow of air through the inlet duct and into the chamber. An induction heating assembly is in thermal communication with the inlet duct and includes an induction coil for generating an electromagnetic field and a heating plate for generating heat when energized by the electromagnetic field.

In another aspect of the present disclosure, an induction heating assembly for heating a flow of air in a dryer appliance is provided. The dryer appliance comprising an inlet duct in fluid communication with a chamber. The induction heating assembly includes an induction coil for generating an electromagnetic field and a heating plate for generating heat when energized by the electromagnetic field.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
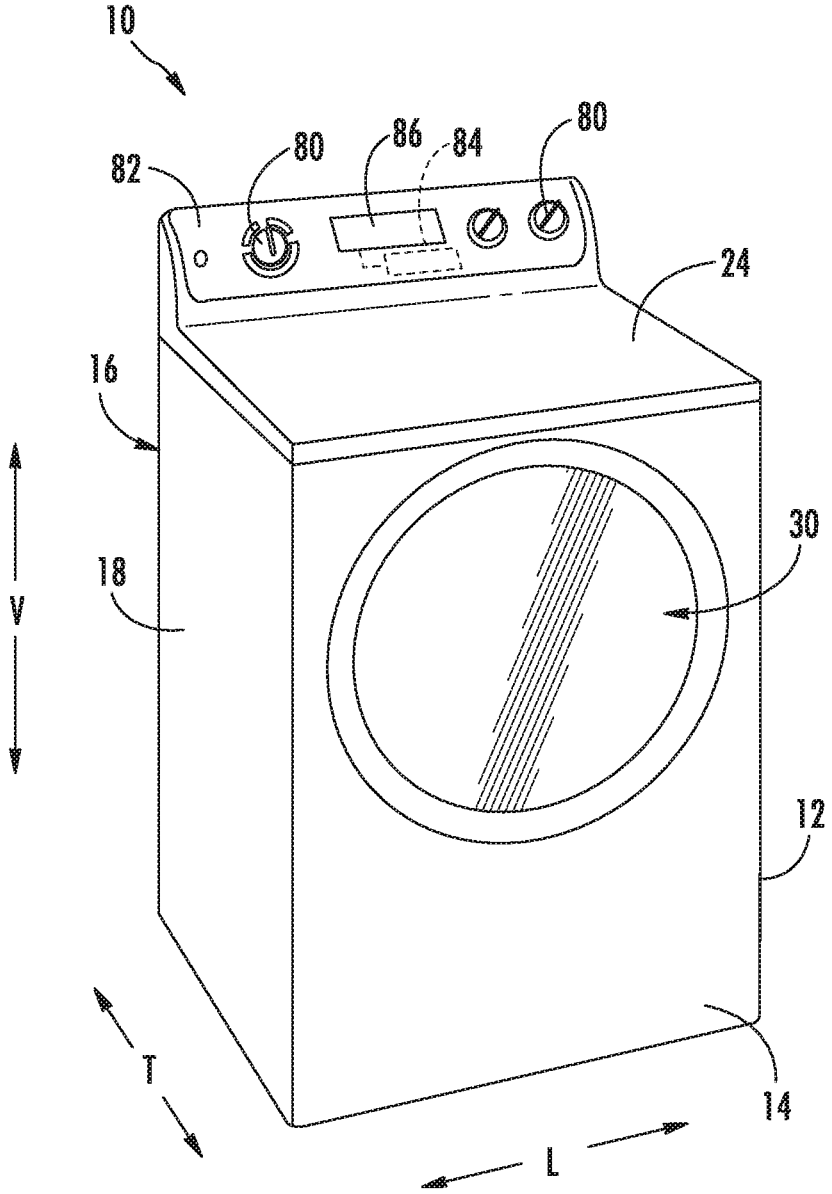
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
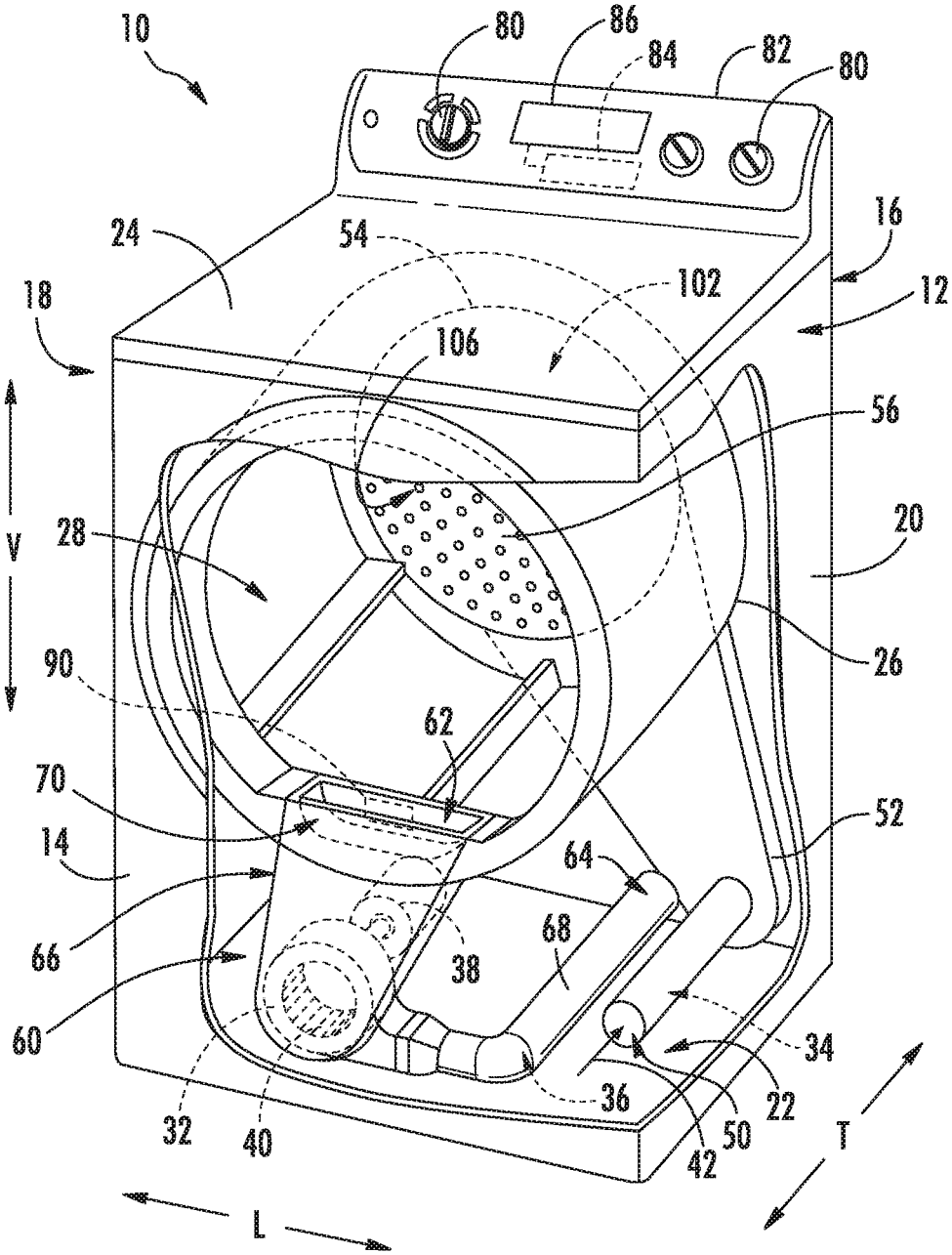
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow through an entrance air passage 34 and an air exhaust passage 36 (which is generally defined within trap duct 66, exhaust conduit 68, and dryer discharge port 64). Specifically, air handler 32 may include a motor 38 which may be in mechanical communication with a blower fan 40, such that motor 38 rotates blower fan 40. In this manner, air handler 32 is configured for drawing a flow of air (indicated by reference numeral 42 in FIGS. 2 through 6) through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26. Furthermore, according to alternative embodiments, air handler 32 may be configured for circulating the flow of air 42 within a recirculation loop instead of continuously drawing in fresh air from within cabinet 12 and discharging that air through dryer discharge port 64.

As will be described in more detail below, drum 26 may be configured to receive heated air 42 that has been heated by a heating assembly (not shown in FIG. 2), e.g., in order to dry damp articles disposed within chamber 28 of drum 26. The heating assembly may generally include one or more heating elements that are in thermal communication with chamber 28. For instance, the heating elements may include one or more electrical resistance heating elements, gas burners, or induction heating elements for heating air being flowed to chamber 28. As discussed above, during operation of dryer appliance 10, motor 38 rotates fan 40 of air handler 32 such that air handler 32 draws air through chamber 28 of drum 26. In particular, air handler 32 urges ambient air 42 into air entrance passage 34 via an entrance 50. Such ambient air is heated by heating assembly and the flow of heated air 42 is drawn from air entrance passage 34, through inlet duct 52, and into drum 26. The heated air enters drum 26 through an outlet of inlet duct 52, otherwise referred to herein as a chamber inlet 54, positioned at a rear wall 56 of drum 26. According to the illustrated exemplary embodiment, rear wall 56 is fixed such that it does not rotate while drum 26 rotates about its central axis.

Within chamber 28, the heated air can remove moisture, e.g., from damp articles disposed within chamber 28. This flow of heated air 42 then flows from chamber 28 through an outlet assembly 60 positioned within cabinet 12. Outlet assembly 60 generally defines air exhaust passage 36 that extends between a chamber outlet 62 and a dryer discharge port 64 defined in rear panel 16 of cabinet 12. Specifically, outlet assembly 60 generally includes a trap duct 66 that extends between chamber outlet 62 and air handler 32, and an exhaust conduit 68 that extends between air handler 32 and dryer discharge port 64. During a dry cycle, the flow of heated air 42 from chamber 28 passes through trap duct 66 to air handler 32 and through exhaust conduit 68 where it is discharged through dryer discharge port 64.

According to exemplary embodiments, an external duct (not shown) is in fluid communication with dryer discharge port 64. For instance, the external duct may be attached (e.g., directly or indirectly attached) to cabinet 12 at rear panel using any suitable connector (e.g., collar, clamp, etc.). In residential environments, the external duct may be in fluid communication with an outdoor environment (e.g., outside of a home or building in which dryer appliance 10 is installed). During a dry cycle, internal air may thus flow from exhaust conduit 68 and through the external duct before being exhausted to the outdoor environment.

In exemplary embodiments, trap duct 66 may include a filter portion 70 which includes a screen filter or other suitable device for removing lint and other particulates as internal air is drawn out of chamber 28. The internal air is drawn through filter portion 70 by air handler 32 before being passed through exhaust conduit 68. After the clothing articles have been dried (or a drying cycle is otherwise completed), the clothing articles are removed from drum 26, e.g., by accessing chamber 28 by opening door 30. The filter portion 70 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, the heating assembly, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance 10. For example, dryer appliance 10 may include one or more temperature sensors 90. Temperature sensor 90 is generally operable to measure internal temperatures in dryer appliance 10. In some embodiments, temperature sensor 90 is disposed proximal to chamber outlet 62 of drum 26 (e.g., within trap duct 66). In additional or alternative embodiments, a temperature sensor 90 is disposed within exhaust conduit 68, or otherwise in thermal communication therewith. For example, temperature sensor 90 may extend at least partially within exhaust passage 36 to measure the temperature of air therethrough. In further additional or alternative embodiments, a temperature sensor 90 may be disposed at any other suitable location within dryer appliance 10 to detect the temperature of the flow of heated air 42 (e.g., downstream from chamber 28). Temperature sensor 90 may be a thermistor, thermocouple, or any other suitable sensor for detecting a specific temperature value of air within appliance 10. When assembled, temperature sensor 90 may be in communication with (e.g., electrically coupled to) controller 84, and may transmit readings to controller 84 as required or desired.

In some embodiments, controller 84 is configured to vary operation of the heating assembly based on one or more temperatures detected at temperature sensor 90. For instance, controller 84 may automatically set or adjust one or more criteria for activation the heating assembly without an estimation of ambient conditions by a user. Specifically, controller 84 may determine an ambient temperature and set or adjust a threshold criterion accordingly. During use, controller 84 can initiate a temperature-contingent dryer cycle wherein a determination about the ambient conditions (e.g., ambient air temperature) is made, and operation of the appliance 10 is modified accordingly.

Figure 3:
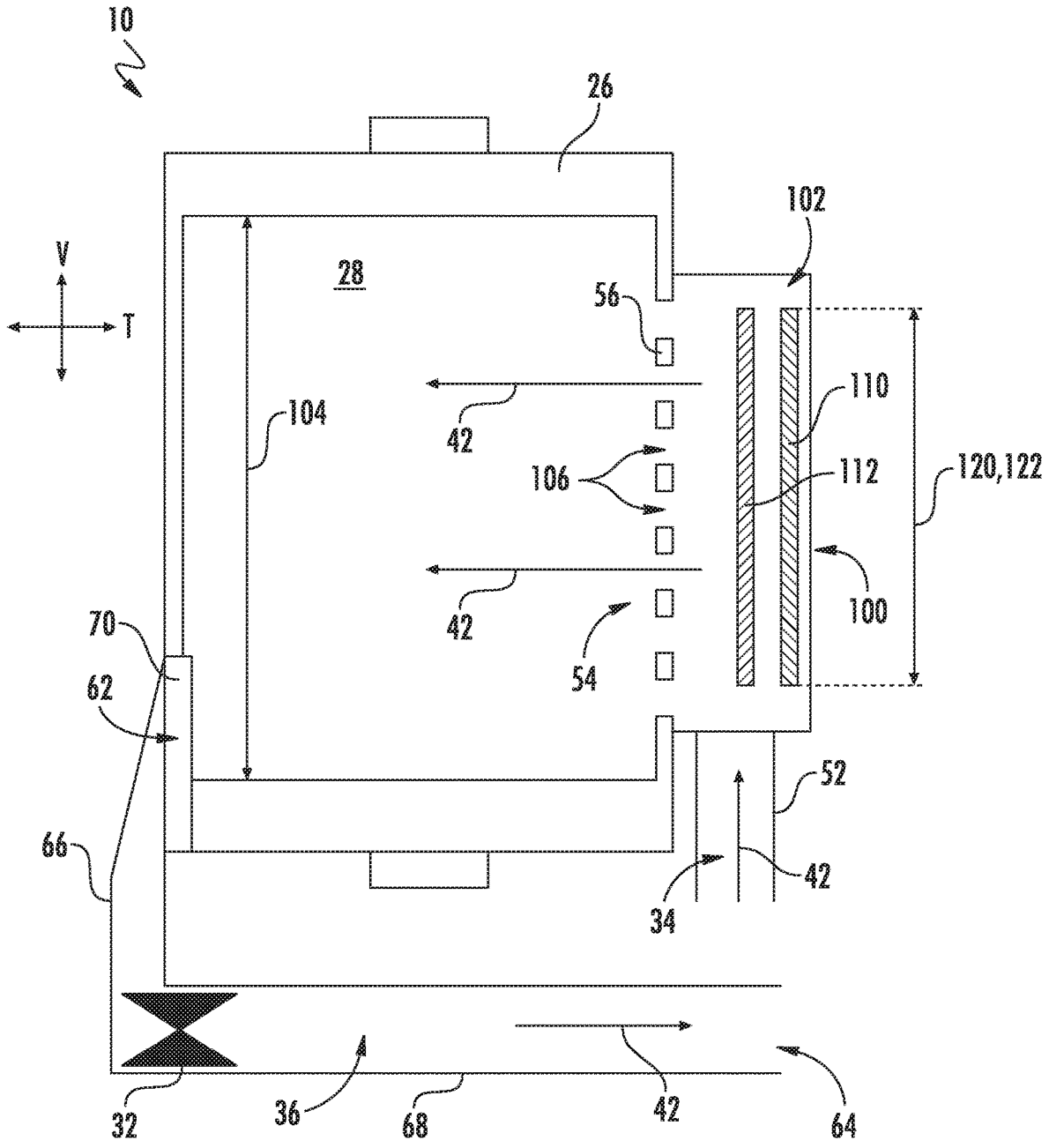
FIG. 3 provides a side schematic view of the exemplary dryer appliance of FIG. 1 including an induction heating assembly according to an exemplary embodiment of the present subject matter.
Figure 4:
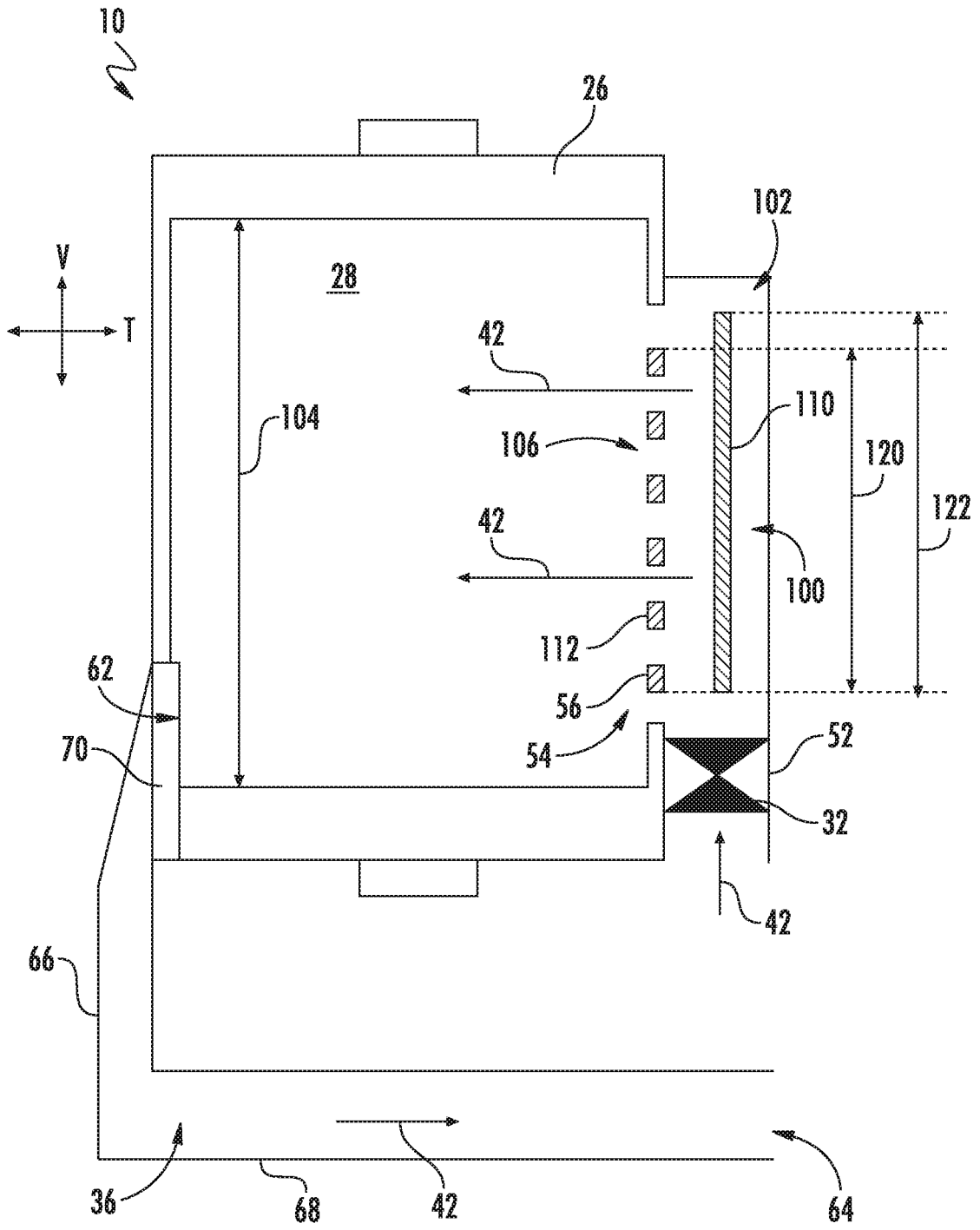
FIG. 4 provides a side schematic view of the exemplary dryer appliance of FIG. 1 including an induction heating assembly according to another exemplary embodiment of the present subject matter.
Figure 5:
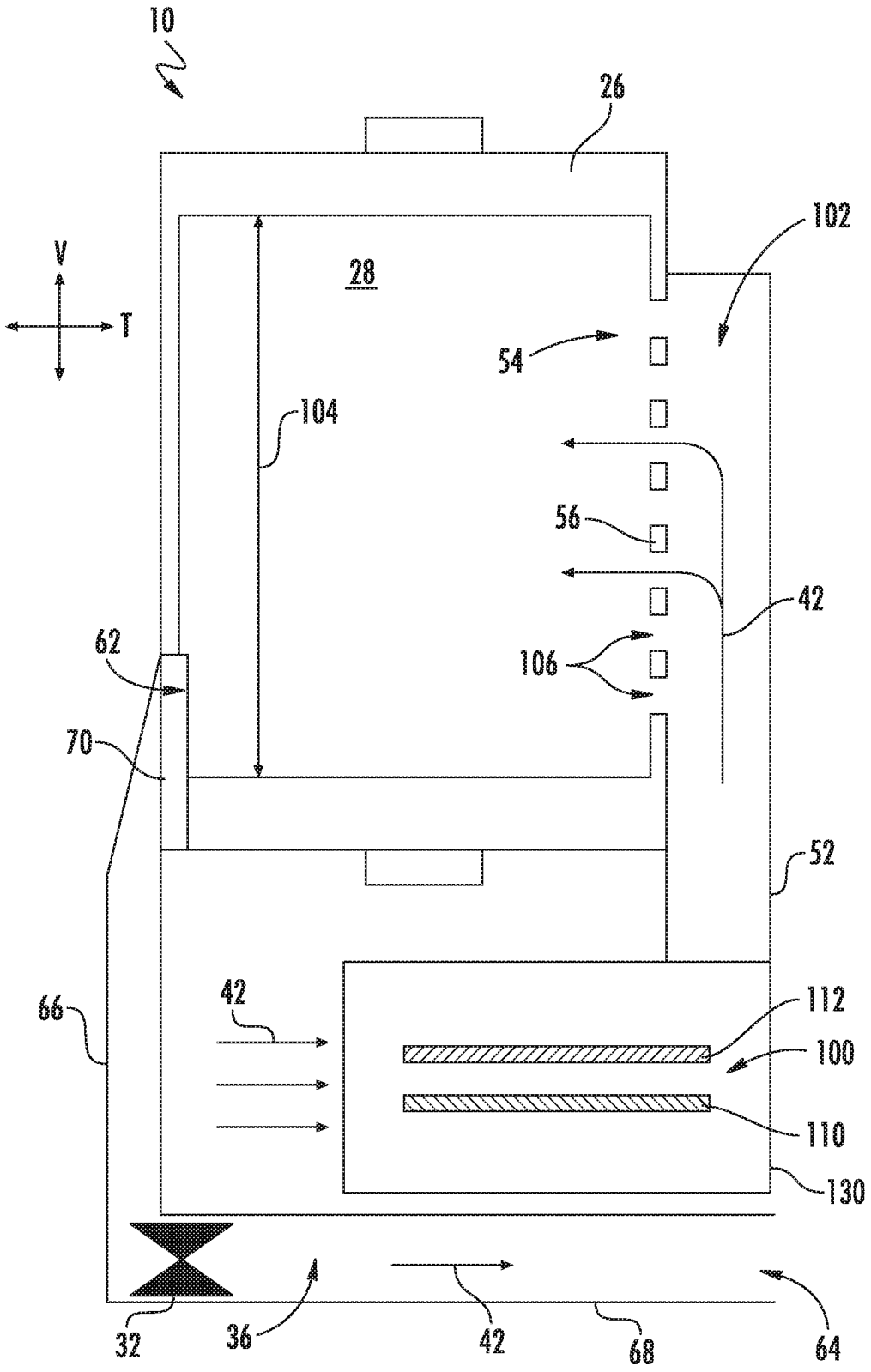
FIG. 5 provides a side schematic view of the exemplary dryer appliance of FIG. 1 including an induction heating assembly according to another exemplary embodiment of the present subject matter.
Figure 6:
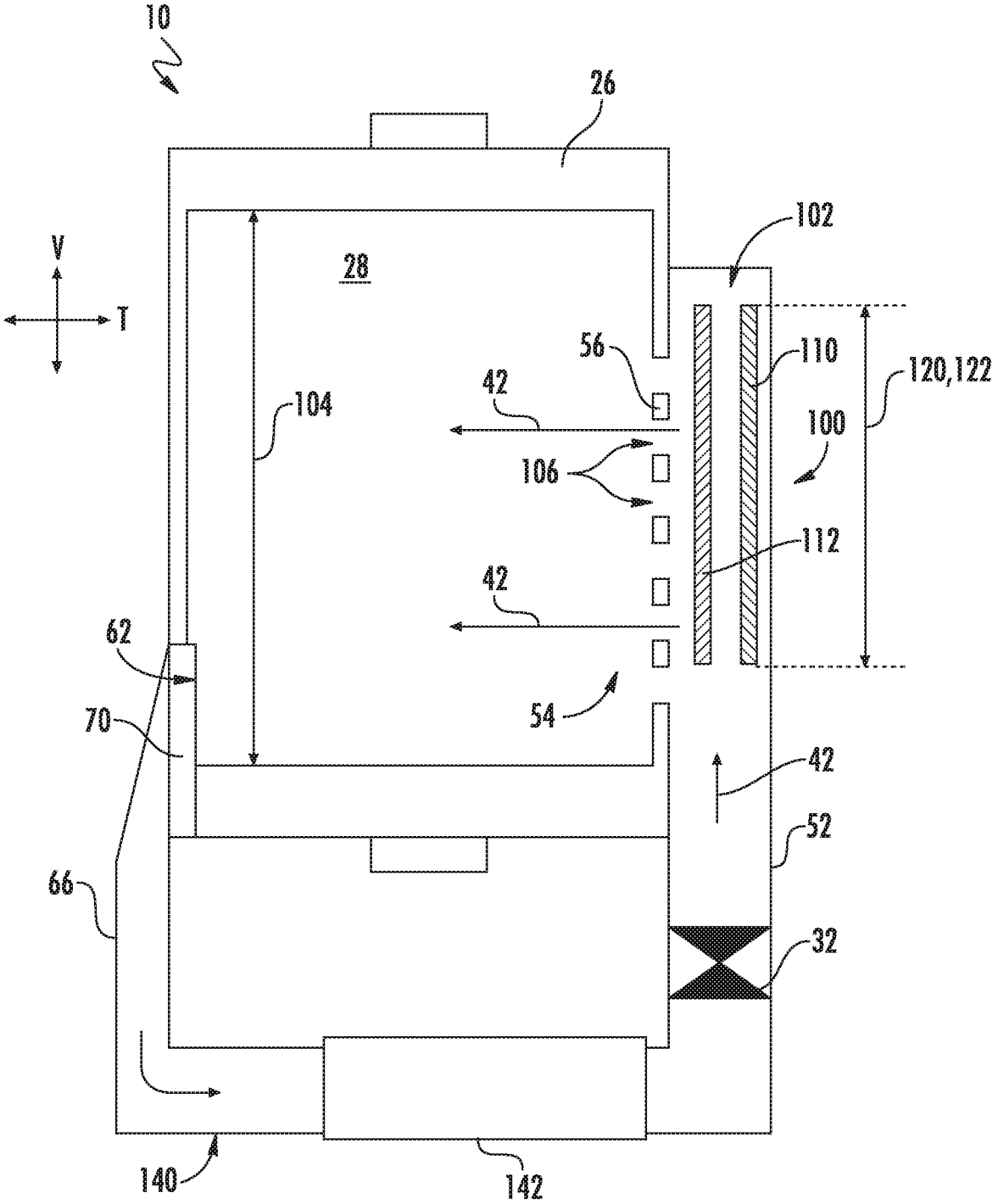
FIG. 6 provides a side schematic view of the exemplary dryer appliance of FIG. 1 including an induction heating assembly according to another exemplary embodiment of the present subject matter.

Referring now to FIGS. 3 through 6, exemplary heating systems which may be used with dryer appliance 10 will be described according to various embodiments. Specifically, these figures show side schematic views of dryer appliance 10 including various configurations of an induction heating assembly 100 for providing the flow of heated air 42 into chamber 28. FIGS. 3 through 5 generally illustrate an "open loop" heating system which draws fresh air in from the cabinet and exhausts that air out of dryer appliance 10. FIG. 6 illustrates a "closed loop" heating system which continuously circulates a flow of air through a recirculation loop. Due to the similarity between each of these exemplary embodiments, similar reference numerals will be used to describe each figure. However, it should be appreciated that the embodiments described are only exemplary and are not intended to limit the present disclosure. In this regard, for example, variations and modifications may be made to induction heating assembly 100 while remaining within the scope of the present subject matter.

As illustrated in FIGS. 3 through 5, induction heating assembly 100 is generally in thermal communication with inlet duct 52 for heating the flow of air 42 prior to entering chamber 28 through chamber inlet 54. According to the illustrated embodiment, inlet duct 52 provides fluid communication between air entrance passage 36 and chamber 28. In addition, inlet duct 52 includes an inlet plenum 102 which is defined behind the rear wall 56 along the transverse direction T. In this regard, inlet plenum 102 may have a plenum diameter that is substantially equivalent to a chamber diameter 104. The flow of air 42 passes through inlet duct 52 and into inlet plenum 102 where it may be dispersed for uniform flow into chamber 28.

In this regard, rear wall 56 of drum 26 may define chamber inlet 54 which is in fluid communication with inlet plenum 102. More specifically, according to the illustrated embodiment, chamber inlet 54 comprises a plurality of holes 106 defined in rear wall 56. In this manner, the flow of air 42 may pass through inlet duct 52, into inlet plenum 102, and into chamber 28 through holes 106. Although the figures herein illustrate chamber inlet 54 as being a plurality of holes 106 defined in rear wall 56, it should be appreciated that according to alternative embodiments, chamber inlet 54 may be any other suitable passage providing fluid communication between inlet plenum 102 and chamber 28.

According to an exemplary embodiment, induction heating assembly 100 generally includes an induction coil 110 positioned in proximity to a heating plate 112. Induction coil 110 is generally configured for generating an electromagnetic field when supplied with a high-frequency alternating current. In addition, heating plate 112 is generally configured for generating heat when energized by the electromagnetic field. In this regard, for example, heating plate 112 may generally be constructed of a ferrous material such as iron, an iron alloy, or any other suitable material that generates heat in the presence of an electromagnetic field.

Notably, according to an exemplary embodiment, controller 84 may be operably coupled to induction coil 110 and may be configured for energizing induction coil 110 as needed for a particular dryer operating cycle. In this regard, for example, controller 84 may be configured for progressively or linearly adjusting the electromagnetic field generated by induction coil 110, thereby enabling fine tuning of the heat generated by induction heating assembly 100 and the corresponding drum temperature. By contrast, conventional resistance heaters have only one or two heating levels.

Referring now to FIGS. 3 and 4, according to an exemplary embodiment, induction heating assembly 100 is positioned behind drum 26 along the transverse direction T. More specifically, induction heating assembly 100 may be positioned within inlet plenum 102 of dryer appliance 10. Air handler 32 may be positioned at any suitable location in fluid communication with inlet plenum 102 for urging the flow of air 42 through induction heating assembly 100 and into chamber 28 through chamber inlet 54. In this regard, as illustrated in FIG. 3, air handler is operably coupled to air exhaust passage 36 (e.g., to trap duct 66 or exhaust conduit 68) for generating a negative pressure within chamber 28 to draw or urge the flow of air 42 through chamber 28. By contrast, as shown in FIG. 4, air handler 32 is operably coupled to inlet duct 52 for generating a positive pressure for pushing or urging the flow of air 42 through chamber 28. It should be appreciated that air handler 32 may be positioned at any other suitable location according to alternative embodiments.

In addition, it should be appreciated that the positions and configurations of induction coil 110 and heating plate 112 may vary while remaining within the scope of the present subject matter. For example, as illustrated in FIG. 3, both induction coil 110 and heating plate 112 are positioned within inlet plenum 102 behind rear wall 56. By contrast, as shown in FIG. 4, heating plate 112 may at least partially defines rear wall 56 of drum 26. In this regard, holes 106 of chamber inlet 54 may be defined through heating plate 112 such that the flow of air 42 passes through heating plate 112 into chamber 28. However, it should be appreciated that heating plate 112 need not have holes 106 according to alternative embodiments.

In addition, according to alternative embodiments, induction coil 110 may be positioned at any other suitable location where the electromagnetic field generated by induction coil 110 may interact with heating plate 112 to generate heat. In this regard, for example, induction coil 110 may be positioned outside of inlet duct 52 and inlet plenum 102, e.g., behind inlet plenum 102 along the transverse direction T. Notably, such a configuration may isolate induction coil 110 and its corresponding electrical connections from moisture within chamber 28 and/or inlet plenum 102.

As illustrated, induction coil 110 and heating plate 112 may be positioned proximate rear wall 56 and may be elongated along the vertical direction V in the lateral direction L. In this manner, for example, heating plate 112 may be a substantially circular plate and may define a heating plate diameter 120 that is greater than half of chamber diameter 104. According still other embodiments, heating plate diameter 120 may be substantially the same as chamber diameter 104. In this manner, the flow of air 42 passing into chamber 28 through chamber inlet 54 may be uniformly heated. Induction coil 110 may also have any suitable size for energizing heating plate 112. For example, induction coil 110 may be coiled about the transverse direction T and may define a coil diameter 122 that is approximately the same size as heating plate 112.

Referring now to FIG. 5, induction heating assembly 100 may be positioned within air entrance passage 34 according to an alternative embodiment. In this regard, induction coil 110 and heating plate 112 may generally extend along the flow direction of the flow of air 42 to increase thermal contact of the flow of air 42 with heating plate 112. Induction coil 110 may be positioned within air entrance passage 34 or immediately adjacent air entrance passage 34 in order to generate an electromagnetic field that heats heating plate 112. The portion of air entrance passage 34 that houses induction heating assembly 100 is referred to generally herein as a heater box 130. According to the illustrated embodiment, heater box 130 is positioned below drum 26, e.g., just downstream of entrance 50 air entrance passage 34.

Referring now to FIG. 6, dryer appliance 10 may alternatively include a recirculation loop 140 for continuously recirculating air 42 through chamber 28. More specifically, for example, air handler 32 may be operably coupled to recirculation loop 140 for urging air 42 through induction heating assembly 100 and into chamber 28. Moisture laden air 42 is then drawn out chamber outlet 62, into trap duct 66, and through a condenser 142. Condenser 142 may be part of a sealed system and is generally configured for lowering the temperature of the flow of air 42 for removing moisture from the air through condensation. Air handler 32 then recirculates the dry air 42 through the induction heating assembly 100 and the process is continuously repeated. Notably, although induction heating assembly 100 is illustrated as being positioned behind rear wall 56, induction heating assembly 100 may have any other suitable position and configuration downstream of condenser 142.

It should be appreciated that the configurations of dryer appliance 10 and induction heating assemblies 100 described above are only used for explaining aspects of the present subject matter. The position and configuration of induction heating assembly 100 may vary according to alternative embodiments. Such variations are contemplated as within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance defining a vertical, a lateral, and a transverse direction, the dryer appliance comprising:

a cabinet;

a drum rotatably mounted within the cabinet, the drum defining a chamber for receipt of clothes for drying and a chamber inlet;

an inlet duct fluidly coupled to the chamber inlet, the inlet duct comprising an inlet plenum defined behind a rear wall of the chamber along the transverse direction;

an air handler in fluid communication with the inlet duct for urging a flow of air through the inlet duct and into the chamber; and an induction heating assembly in thermal communication with the inlet duct, the induction heating assembly comprising:

an induction coil for generating an electromagnetic field; and a heating plate positioned within the inlet plenum for generating heat when energized by the electromagnetic field.

2. The dryer appliance of claim 1, wherein the chamber inlet comprises:

a plurality of holes defined in the rear wall of the chamber.

3. The dryer appliance of claim 2, wherein the rear wall of the chamber is defined at least in part by the heating plate, the plurality of holes being defined by the heating plate.

4. The dryer appliance of claim 2, wherein the induction heating assembly is positioned within the inlet plenum.

5. The dryer appliance of claim 4, wherein the heating plate defines a heating plate diameter, the heating plate diameter being greater than half of a drum diameter.

6. The dryer appliance of claim 1, wherein the induction heating assembly is positioned within a heater box below the drum, the inlet duct providing fluid communication between the heater box and the chamber.

7. The dryer appliance of claim 1, wherein the inlet duct and an exhaust duct define a recirculation loop, and wherein a condenser is operably coupled to the recirculation loop for cooling the flow of air and removing condensate.

8. The dryer appliance of claim 1, wherein the air handler is operably coupled to the inlet duct for generating a positive pressure to urge the flow of air.

9. The dryer appliance of claim 1, wherein the air handler is operably coupled to an exhaust duct for generating a negative pressure to urge the flow of air.

10. The dryer appliance of claim 1, wherein the air handler is a blower fan positioned downstream of a trap duct.

11. The dryer appliance of claim 1, wherein the heating plate comprises iron.

12. The dryer appliance of claim 1, wherein the induction coil is positioned outside the inlet duct.

13. The dryer appliance of claim 1, comprising:

a controller operably coupled with the induction coil, the controller being configured for linearly adjusting the electromagnetic field generated by the induction coil.

14. An induction heating assembly for heating a flow of air in a dryer appliance, the dryer appliance comprising an inlet duct in fluid communication with a chamber, the inlet duct comprising an inlet plenum defined behind a rear wall of the chamber along a transverse direction; the induction heating assembly comprising:

an induction coil for generating an electromagnetic field; and a heating plate positioned within the inlet plenum for generating heat when energized by the electromagnetic field.

15. The induction heating assembly of claim 14, wherein a drum defines a chamber inlet fluidly coupled to the inlet duct and comprising:

a plurality of holes defined in the rear wall of the chamber.

16. The induction heating assembly of claim 15, wherein a rear wall of the chamber is defined at least in part by the heating plate, the plurality of holes being defined by the heating plate.

17. The induction heating assembly of claim 15, wherein the induction heating assembly is positioned within the inlet plenum.

18. The induction heating assembly of claim 14, wherein the induction heating assembly is positioned within a heater box below the chamber, the inlet duct providing fluid communication between the heater box and the chamber.

19. The induction heating assembly of claim 14, wherein the heating plate comprises iron.

20. The induction heating assembly of claim 14, wherein the induction coil is positioned outside the inlet duct.

* * * * *